US008256854B2

(12) United States Patent
Till

(10) Patent No.: US 8,256,854 B2
(45) Date of Patent: Sep. 4, 2012

(54) METHOD AND APPARATUS FOR THE CIRCUMFERENTIAL PRINTING ONTO INDIVIDUAL BOTTLES IN A RUN OF BOTTLES WHERE THE INDIVIDUAL BOTTLES IN THE RUN HAVE AT LEAST ONE VARYING DIMENSION DUE TO MANUFACTURING TOLERANCES, THE METHOD AND APPARATUS PROVIDING MORE CONSISTENT ARTWORK ON INDIVIDUAL CONTAINERS IN THE RUN OF CONTAINERS

(75) Inventor: Volker Till, Hofheim am Taunus (DE)

(73) Assignee: KHS GmbH, Dortmund (DE)

( * ) Notice: Subject to any disclaimer, the term of this patent is extended or adjusted under 35 U.S.C. 154(b) by 394 days.

(21) Appl. No.: 12/370,667

(22) Filed: Feb. 13, 2009

(65) Prior Publication Data

US 2009/0205516 A1 Aug. 20, 2009

Related U.S. Application Data

(63) Continuation-in-part of application No. PCT/EP2007/007189, filed on Aug. 15, 2007, and a continuation-in-part of application No. PCT/EP2007/007190, filed on Aug. 15, 2007.

(30) Foreign Application Priority Data

Aug. 16, 2006 (DE) ..... 10 2006 038 247

(51) Int. Cl.
*B41J 3/00* (2006.01)
*B41J 25/308* (2006.01)
*B41J 2/01* (2006.01)

(52) U.S. Cl. ..... 347/2; 347/4; 347/8; 347/101

(58) Field of Classification Search ..... 347/2, 4, 347/8, 101; 53/544
See application file for complete search history.

(56) References Cited

U.S. PATENT DOCUMENTS

2005/0045263 A1 3/2005 Heuft et al.
2006/0037706 A1 2/2006 Putzer

FOREIGN PATENT DOCUMENTS

CH 6 92 567 8/2002

(Continued)

OTHER PUBLICATIONS

International Search Report PCT/EP2007/007189 and English translation thereof.

(Continued)

*Primary Examiner* — Jason Uhlenhake
(74) *Attorney, Agent, or Firm* — Nils H. Ljungman & Associates

(57) ABSTRACT

A method and apparatus for the circumferential printing onto individual bottles in a run of bottles where the individual bottles in the run have at least one varying dimension due to manufacturing tolerances, the method and apparatus providing more consistent artwork on individual containers in the run of containers. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

20 Claims, 7 Drawing Sheets

FOREIGN PATENT DOCUMENTS

| | | |
|---|---|---|
| DE | 35 26 769 | 1/1987 |
| DE | 44 24 528 | 1/1996 |
| DE | 198 32 548 | 1/2000 |
| DE | 101 15 543 | 10/2002 |
| DE | 20 2006 000 270 | 4/2006 |
| DE | 20 2006 000214 | 4/2006 |
| EP | 0 209 896 | 1/1987 |
| EP | 0 700 781 | 3/1996 |
| EP | 1 038 782 | 9/2000 |
| EP | 1 621 465 | 2/2006 |
| GB | 2 376 920 | 12/2002 |
| JP | 57 004773 | 1/1982 |
| WO | WO 2004/009360 | 1/2004 |
| WO | WO 2004/016438 | 2/2004 |

OTHER PUBLICATIONS

International Search Report PCT/EP2007/007190 and English translation thereof.

METHOD AND APPARATUS FOR THE CIRCUMFERENTIAL PRINTING ONTO INDIVIDUAL BOTTLES IN A RUN OF BOTTLES WHERE THE INDIVIDUAL BOTTLES IN THE RUN HAVE AT LEAST ONE VARYING DIMENSION DUE TO MANUFACTURING TOLERANCES, THE METHOD AND APPARATUS PROVIDING MORE CONSISTENT ARTWORK ON INDIVIDUAL CONTAINERS IN THE RUN OF CONTAINERS

CONTINUING APPLICATION DATA

This application is a Continuation-In-Part application of International Patent Application No. PCT/ET2007/007189, filed on Aug. 15, 2007, which claims priority from Federal Republic of Germany Patent Application No. 10 2006 038 247.1, filed on Aug. 16, 2006. International Patent Application No. PCT/EP2007/007189 was pending as of the filing date of this application. The United States was an elected state in International Patent Application No. PCT/EP2007/007189. This application is a Continuation-In-Part application of International Patent Application No. PCT/EP2007/007190, filed on Aug. 15, 2007, which claims priority from Federal Republic of Germany Patent Application No. 10 2006 038 249.8, filed on Aug. 16, 2006. International Patent Application No. PCT/EP2007/007190 was pending as of the filing date of this application. The United States was an elected state in International Patent Application No. PCT/EP2007/007190.

BACKGROUND

1. Technical Field

The present application relates to a method and apparatus for the circumferential printing onto individual bottles in a run of bottles where the individual bottles in the run have at least one varying dimension due to manufacturing tolerances, the method and apparatus providing more consistent artwork on individual containers in the run of containers.

2. Background Information

Background information is for informational purposes only and does not necessarily admit that subsequently mentioned information and publications are prior art.

Some methods decorate containers made of metal or plastic. To this end, the artwork and/or the printed image is produced as a raster image with jets of ink or paint, for example, according to the ink jet method, the programmed application of individual dots of color along parallel or substantially parallel circumferential lines on the wall. Some methods have proven effective, but run up against limits when one and the same piece of artwork is to be applied to containers of various forms or if the circumferential design or diameter of these containers varies.

To nevertheless achieve three hundred sixty degree printing, for example, one worked in the past with overlap to compensate for the diameter tolerances described above. The overlap region is often monochrome so that it is not recognizable or does not stand out. As a result, more ink or paint than necessary and/or desired is applied on one side while on the other side of the overlap region space is unavailable for additional information or a decoration. This overlap region also disturbs the overall visual impression of such containers.

In practice, bottles and other containers often vary in terms of their diameters, so that the application of artwork, without a single-color overlapping area, on bottles that have different diameters leads to different overall visual impressions, and in most cases a constant or substantially constant, consistent or substantially consistent, identical appearance cannot be achieved. This is one of the disadvantages that may be eliminated, restricted, and/or minimized by this present application.

The present application seeks to alleviate, restrict, and/or minimize these issues.

OBJECT OR OBJECTS

An object of the present application is to refine such a method for the circumferential printing of containers so as to reduce costs and permit a full-surface circumferential design of the containers if necessary or desired. An additional object of the present application may be to achieve for example a visually attractive image with a reduced consumption of material at lower cost that also takes different container shapes into consideration.

SUMMARY

The present application relates to a method and apparatus for the circumferential printing onto individual bottles during a changeover in container size or in a run of bottles where the individual bottles in the run have at least one varying dimension due to manufacturing tolerances, the method and apparatus providing more consistent artwork on individual containers in the run of containers.

These objects may be achieved by means of a generic method, wherein the artwork is supplemented by angle markings regarding its extension in the circumferential direction and/or direction of the vertical axis for initiating the relative rotation between the container and the print head when printing the artwork on the container.

In general, the artwork, which is usually available in digital form as a two-dimensional matrix of colored dots, is applied to the container to be printed using the ink jet method. In this case, the at least one print head is an ink jet print head. In principle, the present application also encompasses other printing methods that work with colored dots that are applied along circumferential lines and/or vertical lines to the container to be printed. To produce the complete artwork, either the circumferential lines are printed line by line and arranged one above the other or the print head is designed so that all or substantially all or most of the circumferential lines are considered in a single pass during the rotation of the container and thus the artwork is applied to the container in question during a single rotation.

It is understood and within the scope of the present application that the container is rotated while the print head remains stationary, but a variant in which the print head is rotated around the container is also covered. Combinations are also plausible, of course. Likewise the possibility to work with multiple print heads (for different colors, for example), which are arranged vertically one above the other and thus enable the complete transfer of the artwork to the circumference of the container during a single rotation.

In each case, the artwork typically comprises colored dots or pixels arranged on a defined surface, which are transferred as dots of ink or paint by the print head to the respective container, where they form the desired printed image.

When transferring the artwork according to the present application, the circumferential lines generally do not have a substantially constant length, i.e. the distance between the individual pixels along these circumferential lines varies from container to container. Instead, these circumferential lines and/or the artwork as a whole are supplemented by angle markings so that the individual pixels are always or substantially always printed in the same angular position on each container.

In the simplest case, an angle marking can be made every ninety degrees, which essentially ensures or promotes that the respective dot of color on the circumferential line appears at exactly or substantially exactly this angular position in the resultant printed image on the container. In this example, the length of the respective circumferential line is equated to a range from zero degrees to three hundred sixty degrees. By so doing, a three hundred sixty degree print can be broken down into four or even eight sections, whose respective start and end points have to assume the angular position specified by the angle marking. This suffices to provide for non-overlapping, three hundred sixty degree printing of the containers. The angle markings, which function as quasi fixed points, essentially ensure or promote that the circumferential lines are compressed or stretched as a function of the diameter of the bottle or container to be printed.

Deviating from the ninety degree angle markings chosen by way of example above, the present application also teaches that these angle markings can be applied in finer graduations.

In principle, it is also possible to flank the artwork with the described or other angle markings regarding its extension in the direction of the vertical axis. This means that if other angle markings are used, it is also possible to allow for different container dimensions not only in the circumferential direction, but also in the direction of the vertical axis. The artwork is also in this case in the form of a two-dimensional matrix, whereby the lines of the vertical axis, on which the individual dots of color are arranged in the direction of the vertical axis, do not have a constant or substantially constant length, but rather can also be compressed or stretched according to the specified (different) angle markings.

However, the artwork is generally supplemented with angle markings only or generally regarding its extension in the circumferential direction. In this way the artwork is applied to the container solely on the basis of angular position in the circumferential direction. Theoretically, any number of angle markings can be used; in actuality, the maximum number of angle markings corresponds to the number of colored dots along the desired circumferential line. The number of angle markings used is typically less than or equal to this number. This allows the artwork to be divided in circumferential direction into individual segments of a circle between two angle markings. This division or the layout as a whole is in one possible embodiment performed such that the distances between the individual dots of color are constant or substantially constant within each circle segment, even though varying spacing is both plausible here and within the scope of the teaching of the present application.

It is also within the scope of the present application to apply the artwork to the container with varying distances between individual dots of color or pixels in the circumferential direction and/or the direction of the vertical axis as a function of the size and shape of the container. It is therefore plausible for the dots of color or pixels to be tightly spaced within a decorative element, whereas in a monochrome region the dots of color would be more widely spaced than in the decorative element.

In each case, the application of the artwork based on angular rather than linear position in the circumferential direction essentially ensures or promotes that different container circumferences and thus varying diameters are properly accounted for in that the corresponding circumferential lines are compressed if the diameter is smaller than with the previous container and stretched if the diameter is larger. This naturally applies to all or substantially all or most circumferential lines of the artwork. It is also understood that the method according to the present application is not limited to the three hundred sixty degree printing of containers, but can be applied just as successfully to sectional printing, whereby the adaptation to various containers with consideration of diameter tolerances always or substantially always results in a uniform appearance and identical proportions.

It has proven effective for the artwork to be stored and provided with the angle markings in a control unit. This control unit is generally present by default, because it is used to actuate a rotary carrier for the container and/or the rotation of the print head. It has also proven favorable to apply the artwork to the circumference of the container by means of a print head, whereby the print head is at a fixed, specified distance from the container/its circumference. The distance of the print head to the container can be adjusted by control action to prevent, restrict, and/or minimize distortion of the printed image on the container caused by variations of the distance between the print head and the container.

Finally, application of the artwork to the container is not restricted to non-overlapping application and also considers the stretching of the artwork perpendicular or virtually perpendicular to the circumferential direction in the direction of the vertical axis. Another object of the present application is a device for the circumferential printing of containers that is in one possible embodiment suitable for the application of the method described. Likewise a container, which is provided with a circumferential printed image according to the method described, which printed image is applied as artwork to the container by rotating the container itself and/or the print head.

The present application teaches a method and a device for the circumferential printing of containers and a container produced accordingly, which are characterized by efficient consumption of e.g. ink or paint, as the overlap region for three hundred sixty degree printing is expressly eliminated, restricted, and/or minimized. This is accomplished essentially by the fact that the artwork is not transferred to the container with circumferential lines of constant or substantially constant length to produce the printed image, but instead the circumferential lines are modified on the basis of the angular position and thus change length as a function of the design and in one possible embodiment the diameter of the container. In other words, the circumferential lines and thus the artwork as a whole is transferred as a function of the angular position to the container in question.

As a result, the same artwork can be applied to containers with different diameters. All or substantially all that is required and/or desired is to stretch or compact the corresponding circumferential lines as a function of whether the diameter is larger or smaller than that of the last bottle or container printed.

On account of the manufacturing tolerances, which are almost inevitable in the manufacturing processes for containers and the related dimensional inconsistencies, even the containers of a single manufacturing lot have diameters, circumferences and/or heights that differ from one container to another. These fluctuations in dimensions or size in a run of containers, blow molded bottles for example, may be on the order of magnitude of +/−three percent. For example, for a lot of eighty-five millimeter diameter containers, the minimum dimension for the circumference may be two hundred fifty-nine millimeters and the maximum dimension may be two hundred seventy-five millimeters. Depending upon the batches of materials used to manufacture the PET bottles, for example, and the conditions and process used the tolerances may be greater or smaller then those indicated, supra, and could vary by tenths or hundredths of a percent of the tolerances indicated above and even may be greater by possibly a percent. All ranges may vary in tenths or hundreths of a percent within the ranges indicated herein. Aspects of the present disclosure may prevent the negative influences on the appearance or aesthetic nature of the labeled container caused by these variations of the circumference. Aspects of the present disclosure may also save printing material as each individual artwork may be sized for each container to fit within a portion of the container for printing or to not overlap or abut.

It should also be emphasized that the artwork and/or the pattern can be provided not only with angle marks in the peripheral direction of the container, but instead or in addition, in the direction of the vertical axis of the respective container. Therefore, the present application may allow for an increases or decreases of the artwork and/or of the pattern in the peripheral direction of the container and/or in the direction of its vertical axis. It thereby becomes possible, for example, to take variable and differing bottles lengths into consideration.

It has also been found to be possible if the artwork and/or the pattern for the respective label can be stored in a control unit where it is provided with the angle marks in question. Naturally it can also be provided with different angle marks on one side for the artwork and on the other side for the pattern. For example, it is conceivable to divide the artwork into segments of twenty degrees of arc each, while the pattern is based on forty-drive degree arc segments. Both the artwork and the pattern are first identified in their longitudinal direction, i.e. in the peripheral direction after application to the container, with the angular area zero degrees to three hundred sixty degrees. In other words, the longitudinal component is replaced by the corresponding angle values.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

One possible embodiment of the present application is described in greater detail below illustrated with the accompanying drawings, in which.

DESCRIPTION OF EMBODIMENT OR EMBODIMENTS

Figure 1:
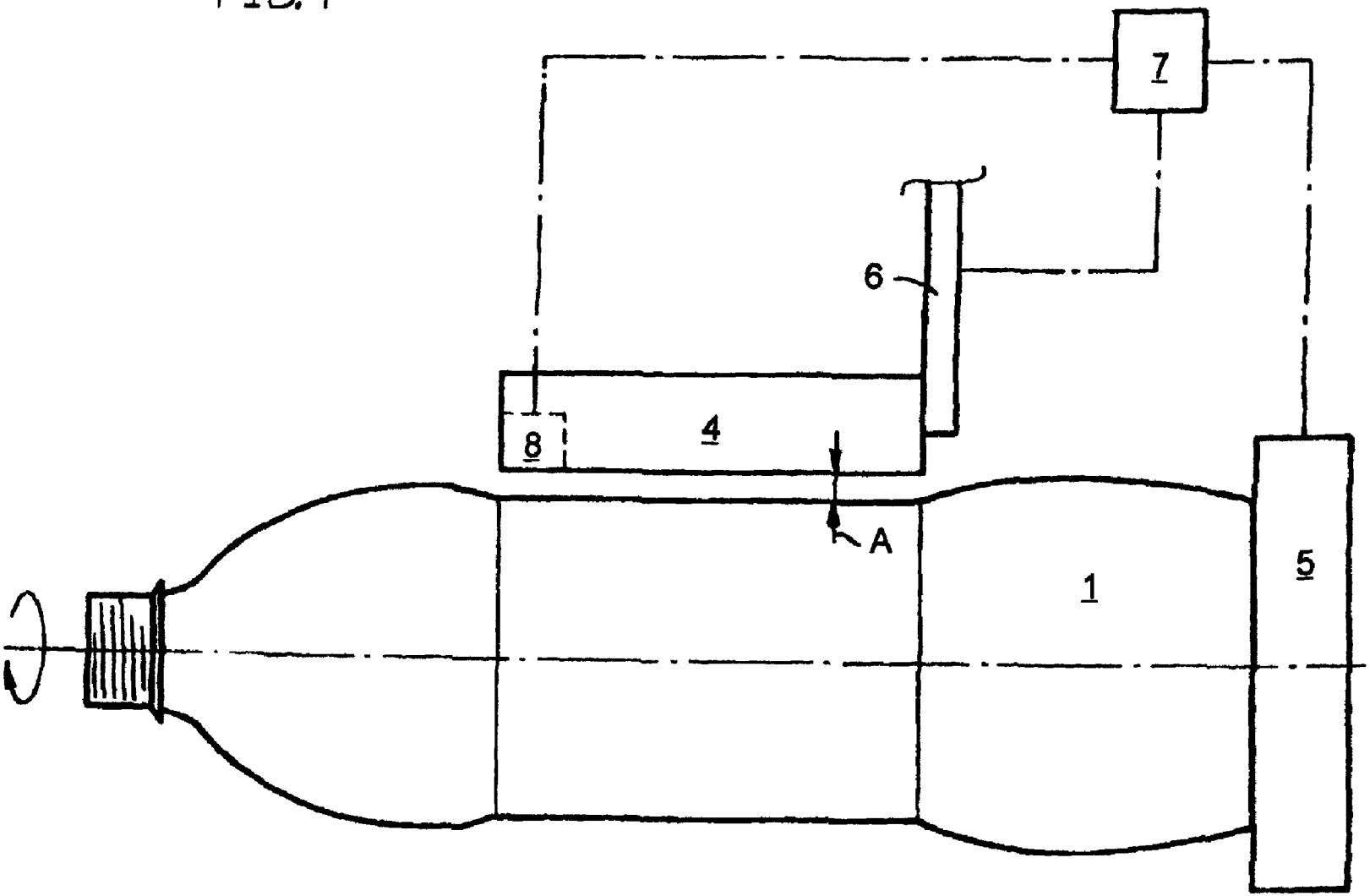
FIG. 1 shows a simplified view of a device for the circumferential printing of containers.

A device for the circumferential printing of containers 1 is shown schematically in FIG. 1. This non-restrictive embodiment is for the three hundred sixty degree printing of cylindrical bottles 1. These bottles 1 could be beverage bottles, which instead of a label bear a three hundred sixty degree print comprising the necessary and/or desired information about the content, the brand, decorative elements, etc. This three hundred sixty degree print is in the form of a printed image 2, which—as will be explained in greater detail below—was applied with no overlap to the container or the bottle 1.

To this end, the present application first avails itself to artwork 3 that is transferred circumferentially by means of one or more print heads 4 to the container 1, where it produces the printed image. The artwork 3 is provided in digital form as a two-dimensional matrix of colored dots or pixels, as is suggested in FIG. 2. The artwork 3 is in fact two-dimensional and extends over defined lengths in the circumferential direction U and the direction of the vertical axis H of the container or the bottle 1.

Figure 2:
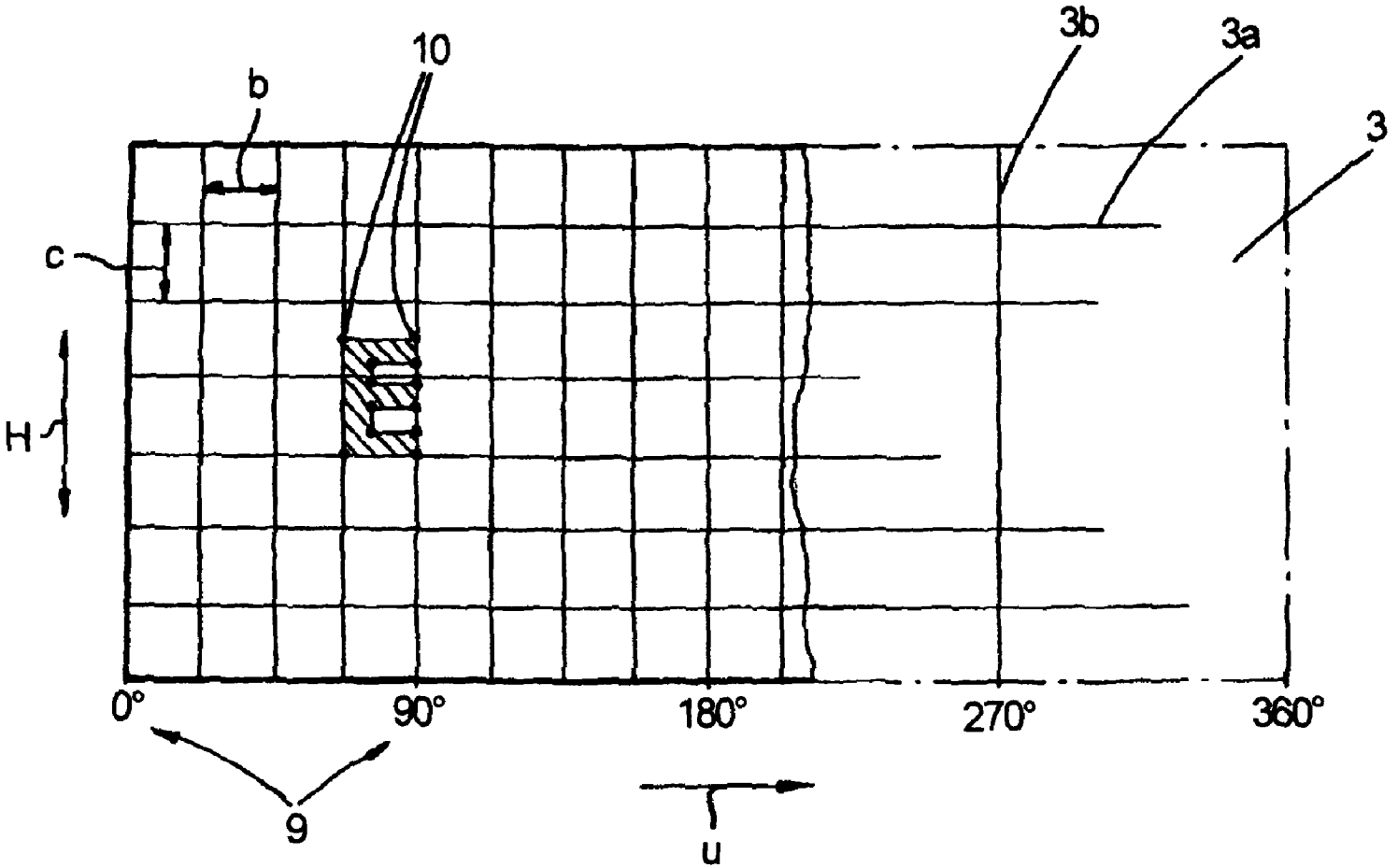
FIG. 2 shows a schematic of the artwork that is transferred to a container, where it produces a printed image.

To transfer the artwork 3 according to FIG. 2 to the container or the bottle 1 as a printed image, this embodiment provides a rotary support 5, which accepts the container or the bottle 1. In contrast, the print head 4 is fixed and in this example can be moved back and forth on a sled 6, so that the distance A of the print head 4 to the container or the bottle 1 can be varied. Both the sled 6 and the rotary carrier 5 or the turntable 5 are connected to a control unit 7. This also applies to a sensor 8 described below, which measures the described distance A between the print head 4 and the container 1 or its circumference and transmits its measurements to the control unit 7.

The artwork 3, which is provided in the form of a file of digital data, for example, is processed in the control unit 7. The artwork 3 is provided with angle markings 9 corresponding to its length in the circumferential direction U, which angle markings as shown in FIG. 2 correspond to a ninety degree rotation of the rotary carrier 5 and consequently of the container 1. In other words, the angle markings 9 are used to initiate or control the rotation of the bottle 1 during printing. For three hundred sixty degree printing, the entire length of the artwork 3 in the circumferential direction U is first equated to an angular range of zero degrees to three hundred sixty degrees.

The artwork 3 is transmitted to the control unit 7 in a certain and specified format, i.e. its circumferential lines 3*a* and its vertical lines 3*b* have a certain length. The present application enables the length of the vertical lines 3*b* as well as and in one possible embodiment the length of the circumferential lines to be varied to account for any possible variations in bottle topology. In this embodiment, the circumferential lines 3*b* are compressed or stretched as a function of whether the diameter of the container 1 to be printed is smaller or larger than that of a preceding container 1 to be processed. The angle markings 9 are provided for performing this adjustment.

Figure 4:
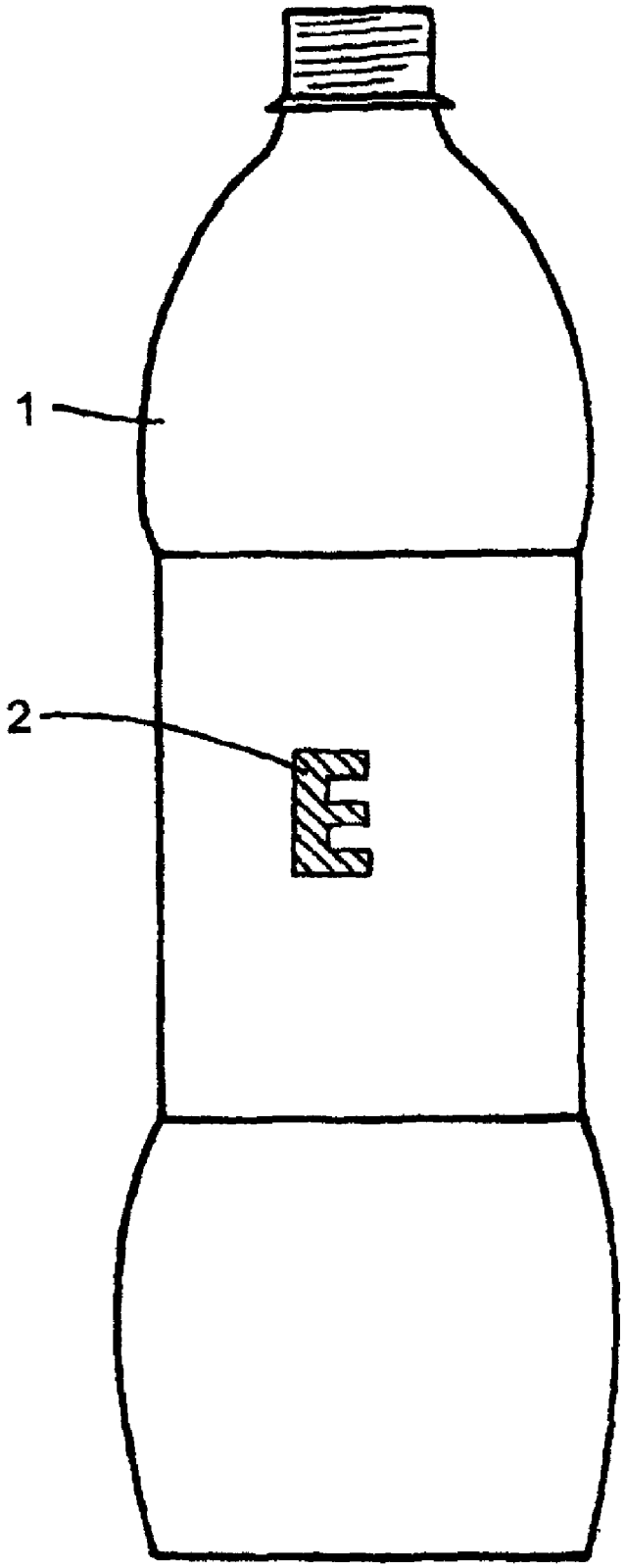
FIG. 4 shows the container printed according to the method according to the present application.

The angle markings 9 correspond to the corresponding angle of rotation of the carrier 5, so that when the respective circumferential lines 3*a* are graduated between zero degrees and three hundred sixty degrees or divided into the four ninety degree sections shown, a three hundred sixty degree print with no overlap can be produced, as is shown in FIG. 4. In fact, the individual dots of color 10 of the artwork 3 are essentially arranged on a grid along the vertical lines 3*b* and the circumferential lines 3*a*, as is illustrated in FIG. 2. The present application essentially ensures or promotes that all or substantially all or most of the dots of color 10 or pixels corresponding to ninety degrees are also applied at this ninety degree angular position on the container 1. The same applies to the dots of color 10 at the one hundred eighty degree angle marking 9, etc. Between the individual angle markings 9, the dots of color 10 are generally arranged equidistant along the respective circumferential line 3*a*.

This does not change if the diameter and consequently the circumference of the container 1 change; the dots of color or pixels 10 in question still assume the ninety degree angular position, the one hundred eighty degree angular position, etc. The distance b between the dots of color 10 changes within the respective ninety degree section. If, for example, the diameter of the bottle 1 to be printed is larger than that of the previous bottle 1, the application of the artwork 3 to the container 1 based on the angular position in the circumferential direction U essentially ensures Gore promotes that the distances b between the individual dots of color or pixels 10 are increased, i.e. that the corresponding circumferential line 3*a* is stretched. Conversely, the smaller diameter of the subsequent bottle 1 automatically results in a compression of the corresponding circumferential line 3*a*.

Figure 3:
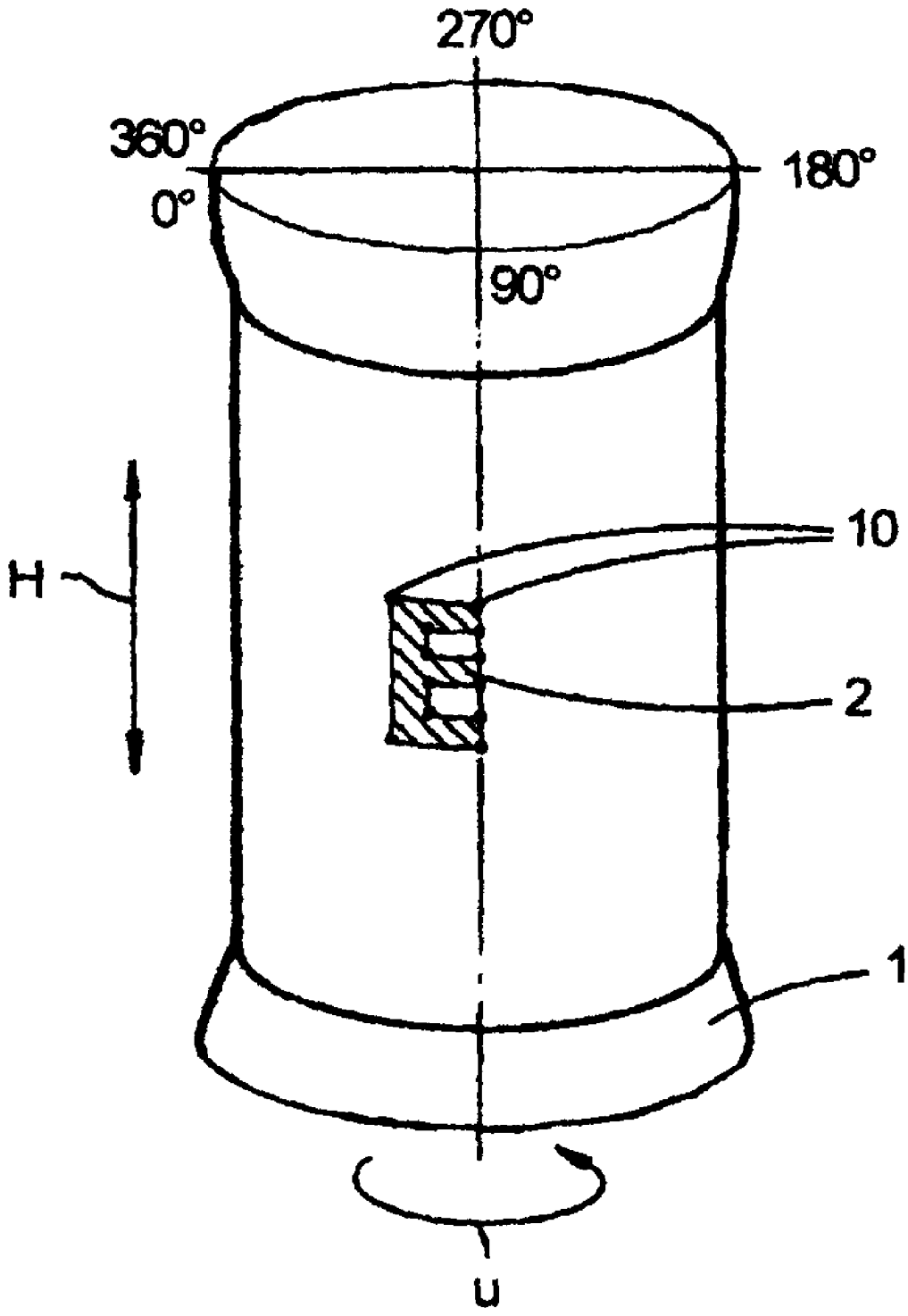
FIG. 3 shows the artwork applied to the container as a finished printed image.

To transfer the artwork 3 to the container or bottle 1 and produce the printed image there, the individual dots of color or pixels 10 are applied in an ink jet process as particles of paint or ink of the desired color to the circumference of the container 1 by means of a print head. As previously elucidated, the print head 4 is seated in an adjustable holder or a sled 6, so that its distance A to the container 1 can be varied. In this non-restrictive embodiment, the sensor 8 measures the distance A of the print head 4 to the container 1. The measurements of the sensor 8 are processed as input control variables in the control unit 7 and serve to control the adjustable holder or the sled 6 to essentially ensure or promote a constant or substantially constant distance A. This essentially ensures or promotes that the artwork 3 is applied undistorted to the container 1 to thereby produce the printed image shown in FIG. 3.

It is understood that the distance c between the dots of color 10 along the vertical lines 3*b* also can be varied in the direction of the vertical axis H. This is merely suggested, however. In any case, the present application takes into account containers 1 with different shapes and in one possible embodiment diameter tolerances for these containers 1. As shown in FIG. 4, the artwork 3 can thus be applied to the container 1 without overlap because the artwork 3—in the case of three hundred sixty degree printing—is essentially divided into three hundred sixty degree angle segments or, as shown in this embodiment, four ninety degree circle segments, which are supplemented by the corresponding angle markings 9. Each angle marking 9 (for example, at ninety degrees, one hundred eighty degrees, etc.) essentially ensures or promotes in the control unit 7 that the container 1 passes through the indicated angle of rotation and the dot of color 10 corresponding to the respective angle marking is applied at precisely or substantially precisely or generally this position. From the angle markings 9 to the angle marking 9, the dots of color 10 are arranged spaced in the circumferential direction U at a constant or substantially constant or varying distance b.

The present application relates to a method and a device for the circumferential printing of containers 1, in one possible embodiment for the three hundred sixty degree printing of bottles 1. The respective container 1 and/or a print head 4 is rotated and is provided with a printed image according to artwork 3. According to the present application, the artwork 3 is supplemented with corresponding angle markings 3 with regard to its extension in the circumferential direction U and/or the direction of the vertical axis H for initiation of the rotary motion during printing.

Figure 1A:
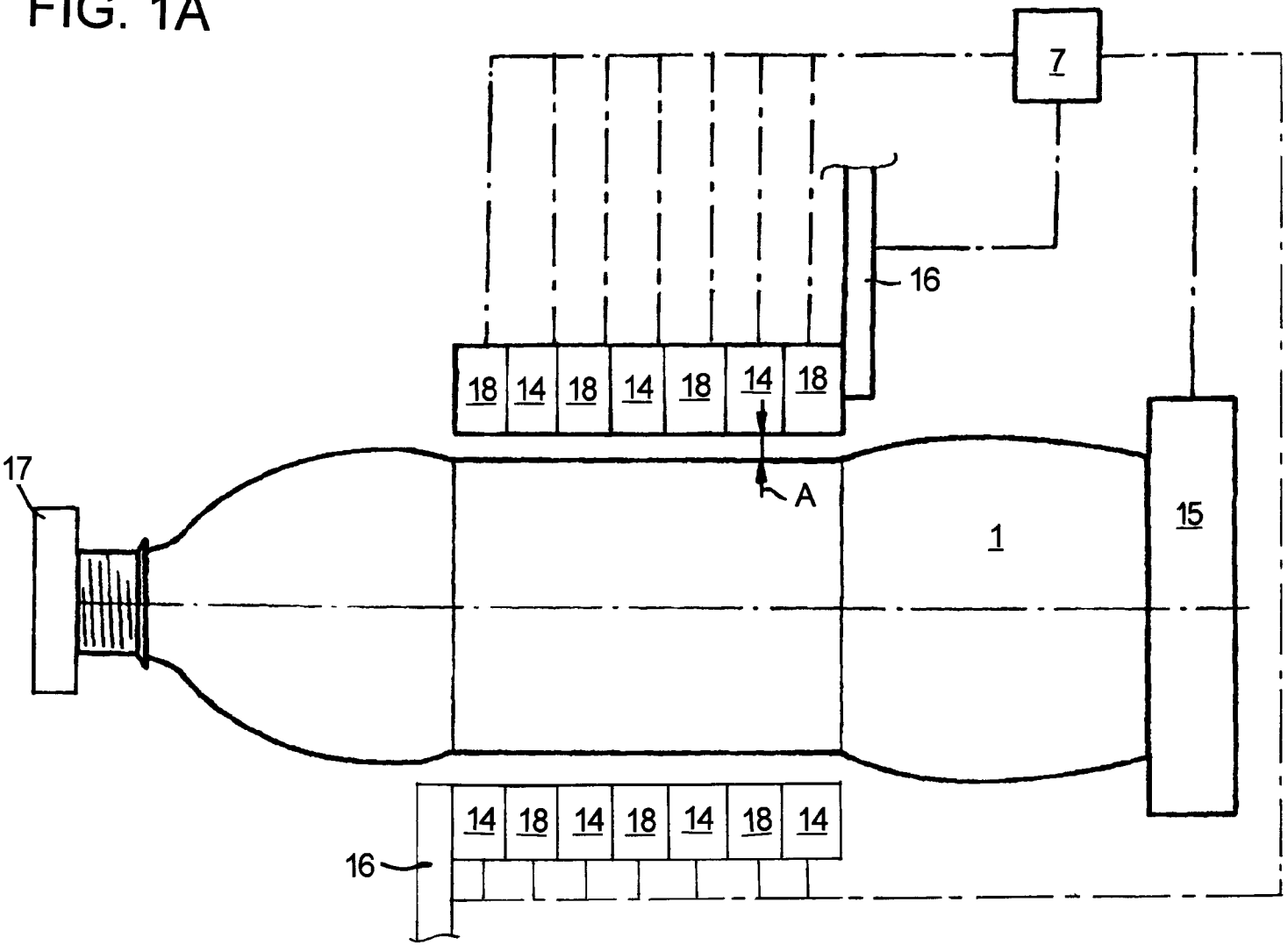
FIG. 1A shows a simplified view of another device for the circumferential printing of containers.

Another device for the circumferential printing of containers 1 is shown schematically in FIG. 1A. This device may provide for up to three hundred sixty degree printing of cylindrical bottles 1. Artwork 3 may be printed onto container 1 by means of one or more print heads 14. The artwork 3 may be provided in digital form as a two-dimensional matrix of colored dots or pixels, as is suggested in FIG. 2. One or more supports may hold container 1 during printing. An embodiment shown in FIG. 1A provides a support 15 at the bottom of container 1 and support 17 at the top of container 1. Supports 15 and 17 may be rotary, or stationary, or may move back and forth with respect to the print heads 14. Print heads 14 may be stationary, rotate about the circumference of container 1, or may be moved back and forth, with respect to container 1, with sleds 16. Also, the distance A of the print heads 14 to container 1 may be varied with sleds 16.

Sensors 18 are configured to sense at least one dimension of container 1. The at least one sensed dimension may be a circumferential dimension or a height dimension, transverse the circumferential dimension. There may be a single sensor 18 or a plurality of sensors 18. Also, there may be a single print head 14 or a plurality of print heads 14. FIG. 1A shows two rows of sensors 18, each having a print head 14 adjacent therewith. It is to be understood that a single print head 14 and a single sensor 18 may provide for printing onto container 1. Additionally, any configuration of print head or print heads 14 and sensor or sensors 18 may be used. A plurality of print heads 14 may provide for printing about a portion of the circumference of container 1 without rotating container 1 or print heads 14. Sleds 16 may be stationary holders and may hold only one or more print heads 14 and/or one or more sensors 18. It is to be understood that there may be an infinite number of configurations of the device for the circumferential printing of containers 1.

Distance A between each sensor 18 and container 1 may be sensed and transmitted to the control unit 7. Other or different dimensions of container 1 may be sensed with one or more sensors 18. For example, a height dimension, transverse the circumference, of a portion of container 1 may be sensed. The measurements made by sensor and/or sensors 18 are processed as input control variables in the control unit 7 and serve to control at least one parameter or dimension of the printed image on container 1. Controlling at least one dimension of the printed image, in response to at least one sensed dimension of container 1, may promote the undistorted application of artwork 3 to container 1 to produce the printed image shown in FIG. 3.

Sizing of an image for each individual container may compensate for variations, due to manufacturing tolerances, in circumferences and/or heights of individual bottles of a nominally similar size to provide a consistent aesthetic appearance of continuous, non-overlapping, uninterrupted artwork. The artwork may extend up to three hundred sixty degrees around the circumference of container 1 or may only extend around a portion of the circumference of container 1. Thus, seamless artwork, without a gap, and some or all parts of the artwork may be positioned on each printed container 1 at a predetermined position with respect to other parts of the artwork.

Additionally, an image may resized for a different size container, as may be advantageous when changing over to printing containers of nominally different size.

Figure 5:
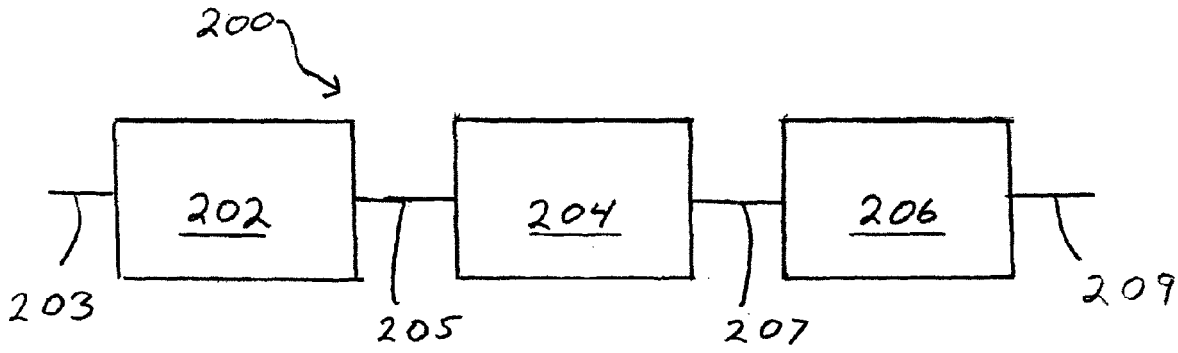
FIG. 5 is a block diagram showing main components of one possible embodiment of a system for filling containers.

FIG. 5 shows process 200 for printing artwork onto containers and filling containers. Printing station 202 may be conveyed empty containers for printing artwork onto an outer surface thereof. Conveyor 203 is configured to convey empty containers to printing station 202. Conveyor 203 may be comprised of grippers, belts, starwheels, and other container moving apparatuses as are known in the art for conveying containers. Printing station 202 has an apparatus configured to print artwork, designs, or other insignia or indications onto the containers conveyed thereto. The printing apparatus may be any type of printing apparatus as is known in the art to print onto containers. Printing station 202 has at least one sensor configured to sense at least one outer dimension of each container being printed. The printing is then sized, in at least one dimension, in response to the at least one sensed dimension of the container.

Sizing each individual printing in response to at least one sensed dimension may provide a means for compensating for variations, due to manufacturing tolerances, in circumferences and/or heights of individual bottles of a nominally similar size to provide a consistent aesthetic appearance of continuous, non-overlapping, uninterrupted artwork, three hundred sixty degrees around the circumference of printed containers. Thus, seamless artwork, without a gap, may have all parts or some parts of the artwork positioned on each printed container at a predetermined position with respect to other parts of the artwork. This may be accomplished for the containers in a filling run of containers, to compensate for manufacturing tolerances. Additionally, the artwork or other printing may be sized for a different size container. Automatically resizing the printing for containers of different sizes may reduce labor costs, when changing over to fill containers of a different nominal size. For example, a change over from printing onto 12 ounce containers to printing onto 16 ounce containers may be accomplished by automatically sensing and resizing the printing for the containers.

The at least one sensed dimension may be a single circumferential dimension, a plurality of circumferential dimensions about different parts of the container, a single height dimension, transverse to the circumference, a plurality of height dimensions, or any combination of sensed dimensions. Therefore, the printing may be specifically sized to accommodate tapers, waves, or other shapes that may vary with containers. These variations in at least one dimension may be due to manufacturing tolerances or may be due to a change over to a different shaped or sized container.

The printing may be specifically sized for an individual container by analyzing the at least one sensed dimension with a mapping, morphing, rectilinear, or other program or method as is known in the art. The printer may comprise a single print head or a plurality of print heads. The container and at least one print head may be stationary with respect to one another during printing. The container and at least one print head may move with respect to one another during printing. For example, one or more print heads may remain stationary while a container being printed upon may be rotated and/or moved in an axial direction. After printing, the containers may be conveyed to filling station 204 with conveyor 205 for filling with a liquid beverage, for example. The filled containers may then conveyed to closing station 206, with conveyor 207, to be closed at closing station 206. Conveyor 209 may then convey containers from closing station 206. Conveyors 205, 207, and 209 may be comprised of grippers, belts, starwheels, and other container moving apparatuses as are known in the art for conveying containers.

Figure 6:
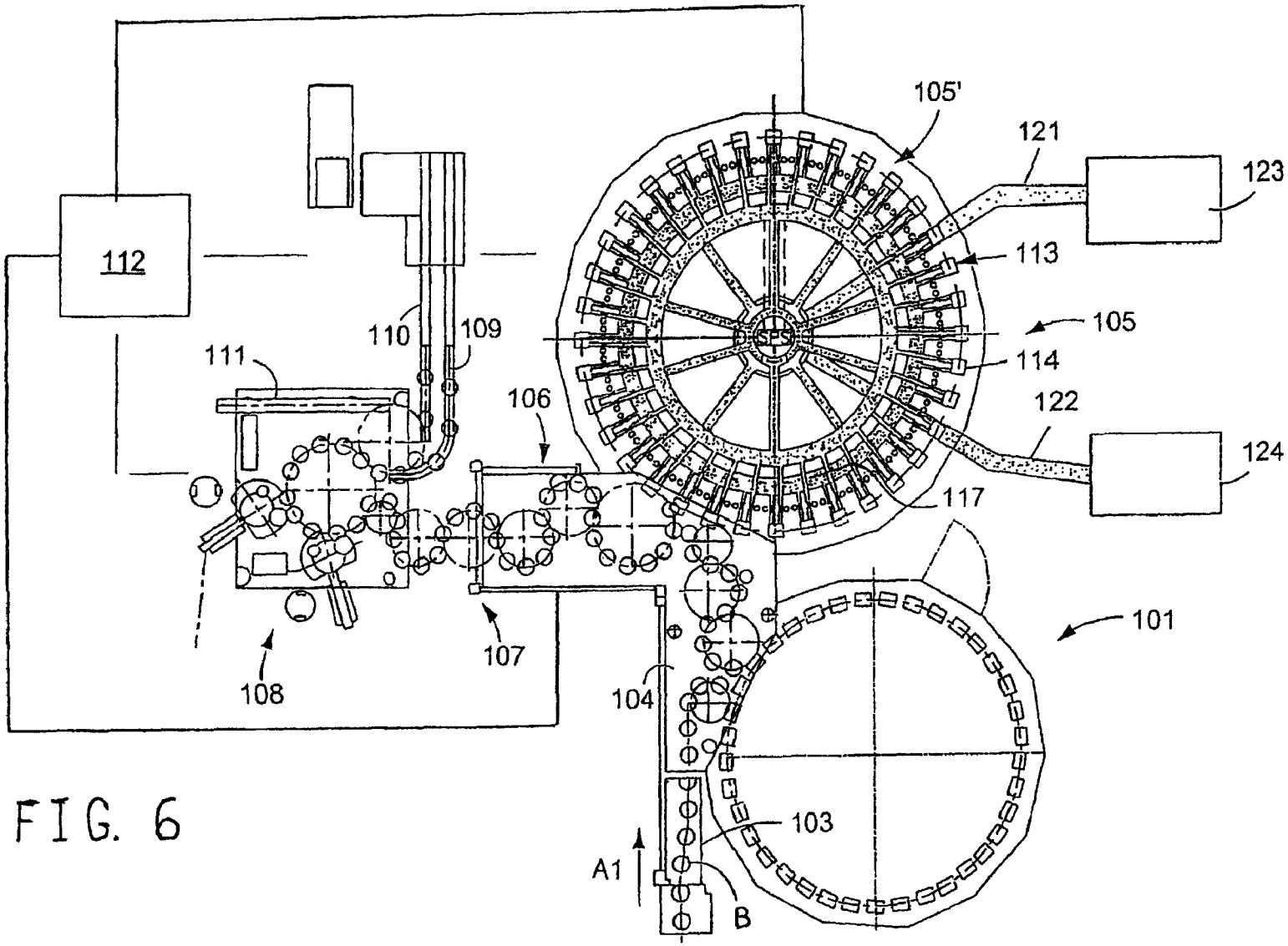
FIG. 6 shows schematically the main components of one possible embodiment example of what may be a typical system for filling containers.

FIG. 6 shows schematically the main components of one possible embodiment example of a system for filling containers, specifically, a beverage bottling plant for filling bottles 130 with at least one liquid beverage, in accordance with at least one possible embodiment, in which system or plant could possibly be utilized at least one aspect, or several aspects, of the embodiments disclosed herein.

FIG. 6 shows a rinsing arrangement or rinsing station 101, to which the containers, namely bottles 130, are fed in the direction of travel as indicated by the arrow 131, by a first conveyor arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyor arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 6, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyor arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 has three output conveyor arrangement: a first output conveyor arrangement 109, a second output conveyor arrangement 110, and a third output conveyor arrangement 111, all of which convey filled, closed, and labeled bottles 130 to different locations.

The first output conveyor arrangement 109, in the embodiment shown, is designed to convey bottles 130 that are filled with a first type of liquid beverage supplied by, for example, the supply reservoir 123. The second output conveyor arrangement 110, in the embodiment shown, is designed to convey bottles 130 that are filled with a second type of liquid beverage supplied by, for example, the supply reservoir 124. The third output conveyor arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyor arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

One feature or aspect of an embodiment is believed at the time if the filing of this patent application to possibly reside broadly in a method for the circumferential printing of containers 1, in one possible embodiment for the three hundred sixty degree printing of bottles 1, whereby the respective container 1 and at least one print head 4 are moved relative to one another, and whereby the container 1 is provided with a printed image according to artwork 3, wherein the artwork 3 is supplemented by corresponding angle markings regarding its extension in the circumferential direction U and/or the direction of the vertical axis H to initiate the relative motion during printing.

Another feature or aspect of an embodiment is believed at the time if the filing of this patent application to possibly reside broadly in the method, wherein the artwork 3 is supplemented exclusively by the angle markings regarding its extension in the circumferential direction U, so that the artwork 3 is applied to the container 1 on the basis of this angular position in the circumferential direction U.

Yet another feature or aspect of an embodiment is believed at the time if the filing of this patent application to possibly reside broadly in the method, wherein the artwork 3 is stored and supplemented with the angle markings 9 in a control unit 7, which is used to initiate a rotary relative motion of the container 1 and the at least one print head 4 during application of the printed image.

Still another feature or aspect of an embodiment is believed at the time if the filing of this patent application to possibly reside broadly in the method, wherein the artwork is applied as a printed image to the circumference of the container 1 by means of a print head 4, whereby the print head 4 is at a fixed, specified distance A from the container A.

A further feature or aspect of an embodiment is believed at the time if the filing of this patent application to possibly reside broadly in the method, wherein the distance A of the print head 4 from the container 1 can be adjusted by control action.

Another feature or aspect of an embodiment is believed at the time if the filing of this patent application to possibly reside broadly in the method, wherein artwork 3 is applied to the container 1 without overlap.

Yet another feature or aspect of an embodiment is believed at the time if the filing of this patent application to possibly reside broadly in the method, wherein artwork 3 is applied to the container 1 perpendicular or substantially to the circumferential direction U according to its extension in the direction of the vertical axis H.

Still another feature or aspect of an embodiment is believed at the time if the filing of this patent application to possibly reside broadly in the method, wherein artwork 3 is applied to the container 1 as a function of the size and shape of the container 1 with varying distances b between individual dots of color 10 in the circumferential direction U and/or direction of the vertical axis H.

A further feature or aspect of an embodiment is believed at the time if the filing of this patent application to possibly reside broadly in the method, wherein the distance b between the dots of color 10 can vary or be fixed in the circumferential direction U and/or the direction of the vertical axis H.

One feature or aspect of an embodiment is believed at the time if the filing of this patent application to possibly reside broadly in a device for the circumferential printing of containers 1, in one possible embodiment for the three hundred sixty degree printing of bottles 1, in one possible embodiment applying the method according to the present application, having a receptacle for the container 1 with at least one print head 4, whereby the container 1 and the print head 4 can be moved relative to one another, and having a control unit 7 for initiating the relative motion and controlling the print head 4, wherein the artwork 3 is supplemented in the control unit 7 with angle markings 9 regarding its extension in the circumferential direction U and/or direction of the vertical axis H to initiate the relative motion between the container 1 and the print head 4 during printing.

Another feature or aspect of an embodiment is believed at the time if the filing of this patent application to possibly reside broadly in the device, wherein the print head 4 is seated in an adjustable holder 6 and is at a specified distance A from the container 1.

Yet another feature or aspect of an embodiment is believed at the time if the filing of this patent application to possibly reside broadly in the device, wherein there is a sensor 8 for measuring the distance A of the print head 4 to the container 1, the measurements of said sensor 8 are analyzed in the control unit 7 as input control variables for the impingement of the holder 6 to essentially ensure or promote a substantially constant and controlled distance A.

Still another feature or aspect of an embodiment is believed at the time if the filing of this patent application to possibly reside broadly in a container 1, in one possible embodiment a bottle 1, having a circumferential printed image that is transferred to the container 1 as artwork 3 by rotating the container 1 and/or a print head 4, wherein the artwork 3 is applied to the container 1 on the basis of the angular position in the circumferential direction U and/or direction of the vertical axis H, whereby the printed image comprises no overlap region when printing over the full circumference of the container 1.

One feature or aspect of an embodiment is believed at the time of the filing of this patent application to possibly reside broadly in a method of printing artwork onto beverage bottles and filling beverage bottles in a beverage bottling plant for filling bottles with a liquid beverage filling material, the method compensating for variations, due to manufacturing tolerances, in circumferences and heights of individual bottles of a nominally similar size to provide a consistent aesthetic appearance of continuous, non-overlapping, uninterrupted artwork, 360° around the circumference of printed bottles, thereby providing seamless artwork, without a gap, and all parts of the artwork positioned on each printed bottle at a predetermined position with respect to other parts of the artwork, for the bottles in a filling run of bottles, the beverage bottling plant comprising: a printing machine comprising a print head configured to print artwork 360° around the circumference of empty bottles; a first conveyor arrangement being configured and disposed to move empty bottles from a supply of bottles to the printing machine; a beverage filling machine comprising a plurality of beverage filling positions, each beverage filling position comprising a beverage filling device for filling bottles with liquid beverage filling material; the filling devices comprising an apparatus configured to introduce a predetermined flow of liquid beverage filling material into the interior of bottles to a predetermined level of liquid beverage filling material; a second conveyor arrangement being configured and disposed to move bottles from the printing machine to the filling machine; a closing machine being configured to close filled bottles; a third conveyor arrangement being configured and disposed to transfer filled bottles from the filling machine to the closing machine; and a fourth conveyor arrangement being configured and disposed to transfer closed bottles from the closing machine; the method of printing and filling beverage bottles comprising the steps of: moving a first empty bottle from the supply of bottles to the printing machine; sensing, to compensate for manufacturing tolerances, at least one circumferential dimension of the outer periphery of the first bottle to be printed by the printing machine; sensing, to compensate for manufacturing tolerances, at least one height dimension, transverse the circumferential dimension, of the outer periphery of the first bottle to be printed by the printing machine; transmitting the at least one sensed circumferential dimension and the at least one sensed height dimension of the first bottle to a controller; calculating at least one first artwork length, to compensate for manufacturing tolerances, the at least one first artwork length being based upon the at least one sensed circumferential dimension and being calculated to dispose the first artwork about the circumference of the first bottle to provide continuous, non-overlapping, uninterrupted artwork, three hundred sixty degrees around the first bottle thereby providing seamless artwork, without a gap or overlap, and all parts of the first artwork positioned on the first bottle at a predetermined position with respect to other parts of the first artwork, for the first bottle; calculating at least one first artwork height, to compensate for manufacturing tolerances, the at least one first artwork height being based upon the at least one sensed height dimension and being calculated to dispose the first artwork about the circumference of the first bottle to provide a consistent aesthetic appearance; printing the first artwork onto the first bottle, the first artwork being adjusted to comprise the at least one first calculated artwork length and the at least one first calculated artwork height; the printing step comprising moving at least one of the first bottle and the print head, with respect to one another; moving the first bottle from the printing machine to the filling machine with the second conveyor arrangement; filling the first bottle with a predetermined amount of liquid beverage filling material with the filling devices; transferring the first filled bottle from the filling machine to the closing machine with the third conveyor arrangement; closing the first bottle with the closing machine; transferring the closed first bottle from the closing machine with the fourth conveyor arrangement; and repeating the steps of printing and filling beverage bottles for subsequent bottles in a run of beverage bottles of a nominally similar size.

Another feature or aspect of an embodiment is believed at the time of the filing of this patent application to possibly reside broadly in a method of operating a printing machine for printing onto containers, the method compensating for variations in at least one dimension of individual containers to compensate for tolerances in manufacturing, which containers vary in at least one of a circumferential dimension and a height dimension, transverse the circumferential dimension, the method comprising the steps of: both of a) and b): a) sensing at least one circumferential dimension of a portion of a first container; determining at least one circumferential dimension of a first printing based upon the at least one sensed circumferential dimension of the portion of the first container, the at least one circumferential dimension being determined to position one part of the first printing at a predetermined position on the first container with respect to another part of the first printing; b) sensing at least one height dimension of the portion of the first container; determining at least one height dimension of the first printing based upon the sensed at least one height dimension of the portion of the first container, the at least one height dimension being determined to position one part of the first printing at a predetermined position on the first container with respect to another part of the first printing; printing the first printing onto the portion of the first container, the first printing being adjusted to comprise the at least one determined circumferential dimension and the at least one determined height dimension; the printing step comprising moving at least one of the first container and a print head configured for printing, with respect to one another; and continuing the process for subsequent containers.

Yet another feature or aspect of an embodiment is believed at the time of the filing of this patent application to possibly reside broadly in a printing machine for printing onto containers, the printing machine comprising: both of a) and b): a) means for sensing at least one circumferential dimension of a portion of a first container; means for determining at least one circumferential dimension of a first printing based upon the at least one sensed circumferential dimension of the portion of the first container, the at least one circumferential dimension being determined to position one part of the first printing at a predetermined position on the first container with respect to another part of the first printing; b) means for sensing at least one height dimension of the portion of the first container; means for determining at least one height dimension of the first printing based upon the sensed at least one height dimension of the portion of the first container, the at least one height dimension being determined to position one part of the first printing at a predetermined position on the first container with respect to another part of the first printing; means for printing the first printing onto the portion of the first container, the first printing being adjusted to comprise the at least one determined circumferential dimension and the at least one determined height dimension; and means for continuing the process for subsequent containers.

Still another feature or aspect of an embodiment is believed at the time of the filing of this patent application to possibly reside broadly in a printing machine for printing onto containers comprising: both of a) and b): a) apparatus configured to sense at least one circumferential dimension of a portion of a first container; apparatus configured to determine at least one circumferential dimension of a first printing based upon the at least one sensed circumferential dimension of the portion of the first container, the at least one circumferential dimension being determined to position one part of the first printing at a predetermined position on the first container with respect to another part of the first printing; b) apparatus configured to sense at least one height dimension of the portion of the first container; apparatus configured to determine at least one height dimension of the first printing based upon the sensed at least one height dimension of the portion of the first container, the at least one height dimension being determined to position one part of the first printing at a predetermined position on the first container with respect to another part of the first printing; apparatus configured to print the first printing onto the portion of the first container, the first printing being adjusted to comprise the at least one determined circumferential dimension and the at least one determined height dimension; and apparatus configured to continue the process for subsequent containers.

A further feature or aspect of an embodiment is believed at the time of the filing of this patent application to possibly reside broadly in a method of operating a printing machine for printing onto containers, the first printing comprising at least one of a), b), c), and d): a) a first predetermined part of the first printing disposed at a predetermined angle with respect to another predetermined part of the first printing, the predetermined angle being measured about the circumference of the first container; b) a first predetermined part of the first printing disposed at a predetermined distance from another predetermined part of the first printing, the predetermined distance being measured about the height of the first container; c) a first predetermined pixel of the first printing disposed at a predetermined angle with respect to another predetermined pixel of the first printing, the predetermined angle being measured about the circumference of the first container; d) a first pixel of the first printing disposed at a predetermined distance from another predetermined pixel of the first printing, the predetermined distance being measured about the height of the first container.

Another feature or aspect of an embodiment is believed at the time of the filing of this patent application to possibly reside broadly in a method of operating a printing machine for printing onto containers wherein the step of printing the first printing onto the portion of the first container further comprises: printing three hundred sixty degrees about the circumferential dimension of the first container.

Yet another feature or aspect of an embodiment is believed at the time of the filing of this patent application to possibly reside broadly in a method of operating a printing machine for printing onto containers wherein the first printing is continuous and non-overlapping.

Still another feature or aspect of an embodiment is believed at the time of the filing of this patent application to possibly reside broadly in a method of operating a printing machine for printing onto containers wherein the step of printing the first printing onto the portion of the first container further comprises: moving at least one of the first container and at least one print head, with respect to one another.

A further feature or aspect of an embodiment is believed at the time of the filing of this patent application to possibly reside broadly in a method of operating a printing machine for printing onto containers wherein the step of printing the first printing onto the portion of the first container further comprises: printing in a direction substantially parallel to the at least one sensed height dimension of the portion of the first container.

Another feature or aspect of an embodiment is believed at the time of the filing of this patent application to possibly reside broadly in a method of operating a printing machine for printing onto containers wherein the method further comprises a) or b): a) maintaining a selected distance between the at least one print head and the first container; b) adjusting a distance between the at least one print head and the first container.

Yet another feature or aspect of an embodiment is believed at the time of the filing of this patent application to possibly reside broadly in a method of operating a printing machine for printing onto containers, the method compensating for differences in at least one dimension of containers, which containers differ in at least one of a circumferential dimension and a height dimension, transverse the circumferential dimension, the method comprising the steps of: at least one of a) and b): a) sensing at least one circumferential dimension of a portion of a first container; determining at least one circumferential dimension of a first printing based upon the at least one sensed circumferential dimension of the portion of the first container, the at least one circumferential dimension being determined to position one part of the first printing at a predetermined position on the first container with respect to another part of the first printing; b) sensing at least one height dimension of the portion of the first container; determining at least one height dimension of the first printing based upon the sensed at least one height dimension of the portion of the first container, the at least one height dimension being determined to position one part of the first printing at a predetermined position on the first container with respect to another part of the first printing; and printing the first printing onto the portion of the first container, the first printing being adjusted to comprise at least one of the at least one determined circumferential dimension and the at least one determined height dimension.

One feature or aspect of an embodiment is believed at the time of the filing of this patent application to possibly reside broadly in a printing machine for printing onto containers, the printing machine comprising: at least one of a) and b): a) means for sensing at least one circumferential dimension of a portion of a first container; means for determining at least one circumferential dimension of a first printing based upon the at least one sensed circumferential dimension of the portion of the first container, the at least one circumferential dimension being determined to position one part of the first printing at a predetermined position on the first container with respect to another part of the first printing; b) means for sensing at least one height dimension of the portion of the first container; means for determining at least one height dimension of the first printing based upon the sensed at least one height dimension of the portion of the first container, the at least one height dimension being determined to position one part of the first printing at a predetermined position on the first container with respect to another part of the first printing; and means for printing the first printing onto the portion of the first container, the first printing being adjusted to comprise at least one of the at least one determined circumferential dimension and the at least one determined height dimension.

Another feature or aspect of an embodiment is believed at the time of the filing of this patent application to possibly reside broadly in a printing machine for printing onto containers, the printing machine comprising: at least one of a) and b): a) apparatus configured to sense at least one circumferential dimension of a portion of a first container; apparatus configured to determine at least one circumferential dimension of a first printing based upon the at least one sensed circumferential dimension of the portion of the first container, the at least one circumferential dimension being determined to position one part of the first printing at a predetermined position on the first container with respect to another part of the first printing; b) apparatus configured to sense at least one height dimension of the portion of the first container; apparatus configured to determine at least one height dimension of the first printing based upon the sensed at least one height dimension of the portion of the first container, the at least one height dimension being determined to position one part of the first printing at a predetermined position on the first container with respect to another part of the first printing; and apparatus configured to print the first printing onto the portion of the first container, the first printing being adjusted to comprise at least one of the at least one determined circumferential dimension and the at least one determined height dimension.

Yet another feature or aspect of an embodiment is believed at the time of the filing of this patent application to possibly reside broadly in a method of operating a printing machine for printing onto containers comprising both of the steps of a) and b).

Still another feature or aspect of an embodiment is believed at the time of the filing of this patent application to possibly reside broadly in a method of operating a printing machine for printing onto containers, the first printing comprising at least one of a), b), c), and d): a) a first predetermined part of the first printing disposed at a predetermined angle with respect to another predetermined part of the first printing, the predetermined angle being measured about the circumference of the first container; b) a first predetermined part of the first printing disposed at a predetermined distance from another predetermined part of the first printing, the predetermined distance being measured about the height of the first container; c) a first predetermined pixel of the first printing disposed at a predetermined angle with respect to another predetermined pixel of the first printing, the predetermined angle being measured about the circumference of the first container; d) a first pixel of the first printing disposed at a predetermined distance from another predetermined pixel of the first printing, the predetermined distance being measured about the height of the first container.

A further feature or aspect of an embodiment is believed at the time of the filing of this patent application to possibly reside broadly in a method of operating a printing machine for printing onto containers wherein the step of printing the first printing onto the portion of the first container further comprises: printing three hundred sixty degrees about the circumferential dimension of the first container.

Another feature or aspect of an embodiment is believed at the time of the filing of this patent application to possibly reside broadly in a method of operating a printing machine for printing onto containers wherein the first printing is continuous and non-overlapping.

Yet another feature or aspect of an embodiment is believed at the time of the filing of this patent application to possibly reside broadly in a method of operating a printing machine for printing onto containers wherein the step of printing the first printing onto the portion of the first container further comprises: moving at least one of the first container and at least one print head, with respect to one another.

Still another feature or aspect of an embodiment is believed at the time of the filing of this patent application to possibly reside broadly in a method of operating a printing machine for printing onto containers wherein the step of printing the first printing onto the portion of the first container further comprises: printing in a direction substantially parallel to the at least one sensed height dimension of the portion of the first container.

A further feature or aspect of an embodiment is believed at the time of the filing of this patent application to possibly reside broadly in a method of operating a printing machine for printing onto containers wherein the method further comprises a) or b): a) maintaining a selected distance between the at least one print head and the first container; b) adjusting a distance between the at least one print head and the first container.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of bottling systems which may be used or adapted for use in at least one possible embodiment of the present application may be found in the following U.S. patents assigned to the Assignee herein, namely: U.S. Pat. Nos. 4,911,285; 4,944,830; 4,950,350; 4,976,803; 4,981,547; 5,004,518 5,017,261; 5,062,917; 5,062,918; 5,075,123 5,078,826; 5,087,317; 5,110,402; 5,129,984 5,167,755; 5,174,851; 5,185,053; 5,217,538 5,227,005; 5,413,153; 5,558,138; 5,634,500 5,713,403; 6,276,113; 6,213,169; 6,189,578 6,192,946; 6,374,575; 6,365,054; 6,619,016. 6,474,368; 6,494,238; 6,470,922; and No. 6,463,964.

Some examples of cameras or the like optical monitoring apparatus that may possibly be utilized or possibly adapted for use in at least one possible embodiment of the present application may possibly be found in the following U.S. Pat. No. 5,233,186 issued to Ringlien on Aug. 3, 1993; U.S. Pat. No. 5,243,400 issued to Ringlien on Sep. 7, 1993; U.S. Pat. No. 5,369,713 issued to Schwartz et al. on Nov. 29, 1994; U.S. Pat. No. 5,442,446 issued to Gerber et al. on Aug. 15, 1995; U.S. Pat. No. 5,661,295 issued to Buchmann et al. on Aug. 26, 1997; and U.S. Pat. No. 5,898,169 issued to Nodbryhn on Apr. 27, 1999.

Some examples of position sensors or position sensor systems that may be used or adapted for use in at least one possible embodiment of the present invention may be found in the following U.S. Pat. No. 5,794,355, issued to inventor Nickum on Aug. 18, 1998; U.S. Pat. No. 5,520,290, issued to inventors Kumar et al. on May 28, 1996; U.S. Pat. No. 5,074,053, issued to inventor West on Dec. 24, 1991; and U.S. Pat. No. 4,087,012, issued to inventor Fogg on May 2, 1978.

Some examples of laser printing arrangements that may possibly be utilized or possibly adapted for use in at least one possible embodiment of the present application may possibly be found in the following U.S. Pat. No. 4,847,643 issued to Ohmori on Jul. 11, 1989; U.S. Pat. No. 5,294,945 issued to Omura et al. on Mar. 15, 1994; U.S. Pat. No. 5,528,280 issued to Endo et al. on Jun. 18, 1996; U.S. Pat. No. 6,210,778 issued to Poirier et al. on Apr. 3, 2001; U.S. Pat. No. 6,433,810 issued to Katayama et al. on Aug. 13, 2002; and U.S. Pat. No. 6,655,275 issued to Mugrauer on Dec. 2, 2003.

Some examples of ink jet printing apparatus and methods that may possibly be utilized or possibly adapted for use in at least one possible embodiment of the present application may possibly be found in the following U.S. Pat. No. 6,582,047 issued to Koitabashi et al. on Jun. 24, 2003; U.S. Pat. No. 6,623,093 issued to Takahashi et al. on Sep. 23, 2003; U.S. Pat. No. 6,625,351 issued to Cox et al. on Sep. 23, 2003; U.S. Pat. No. 6,652,055 issued to Oikawa on Nov. 25, 2003; U.S. Pat. No. 6,669,767 issued to Blease et al. on Dec. 30, 2003; and U.S. Pat. No. 6,688,739 issued to Murray on Feb. 10, 2004.

Some examples of apparatus and methods for the drying and/or hardening of ink that may possibly be utilized or adapted for use in at least one possible embodiment may possibly be found in the following U.S. Pat. No. 6,493,018, entitled "Wide format thermal printer;" U.S. Pat. No. 6,957,030, entitled "Method and apparatus for making signs;" U.S. Pat. No. 4,970,528, entitled "Method for uniformly drying ink on paper from an ink jet printer;" U.S. Pat. No. 6,312,123, entitled "Method and apparatus for UV ink jet printing on fabric and combination printing and quilting thereby;" and U.S. Pat. No. 6,857,737, entitled "UV ink printed graphic article."

Some examples of computer systems that may possibly be utilized or possibly adapted for use in at least one possible embodiment of the present application may possibly be found in the following U.S. Pat. No. 5,416,480 issued to Roach et al. on May 16, 1995; U.S. Pat. No. 5,479,355 1243 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

Some examples of printing sizing programs or methods that may possibly be utilized or possibly adapted for use in at least one possible embodiment of the present application may possibly be found in the following U.S. Pat. No. 6,714,949, entitled "Dynamic file system configurations," issued to Frey Jr., Alexander H., published on Mar. 30, 2004; U.S. Pat. No. 5,967,032, entitled "Printing process using a thin sheet lenticular lens material," issued to Bravenec et al., published on Oct. 19, 1999; U.S. Pat. No. 7,379,811, entitled "Digital mapping system," issued to Rasmussen et al., published on May 27, 2008; U.S. Pat. No. 7,111,915, entitled "Methods and apparatus for image transfer," issued to Martinez et al., published on Sep. 26, 2006; and U.S. Pat. No. 6,573,899, entitled "Morphing processing apparatus, method, storage medium, program transmission apparatus, and animation creation apparatus," issued to Aono, Masaki, published on Jun. 3, 2003.

The "Tonejet" printhead, developed by The Technology Partnership Plc, is an example of a printhead which may possibly be utilized or adapted for use in at least one possible embodiment. Some examples of printheads that may possibly be utilized or adapted for use in at least one possible embodiment may possibly be found in the following U.S. Pat. No. 7,387,366, issued Jun. 17, 2008, entitled "Printhead;" U.S. Pat. No. 6,820,965, issued Nov. 23, 2004, entitled "Drop-on-Demand Printer;" U.S. Pat. No. 7,407,271, issued Aug. 5, 2008, entitled "Self-Cooling Thermal Ink Jet Printhead;" and U.S. Pat. No. 7,380,906, issued Jun. 3, 2008, entitled "Printhead."

The following patents, patent applications or patent publications, are hereby incorporated by reference as if set forth in their entirety herein: DE 35 26 769 A1, having the following English translation of the German title, "METHOD AND APPARATUS FOR DECORATING METAL OR PLASTIC CONTAINERS," published on Jan. 29, 1987; and U.S. patent application Ser. No. 12/355,870, filed on Jan. 19, 2009, having inventor Volker TILL, and title "METHOD AND APPARATUS FOR THE CIRCUMFERENTIAL LABELING OF A RUN OF BLOW MOLDED BOTTLES WHERE THE INDIVIDUAL BOTTLES IN THE RUN HAVE AT LEAST ONE VARYING DIMENSION DUE TO MANUFACTURING TOLERANCES, THE METHOD AND APPARATUS PROVIDING MORE CONSISTENT LABELING OF INDIVIDUAL CONTAINERS IN THE RUN OF CONTAINERS," and its corresponding Federal Republic of Germany Patent Application No. 10 2006 038 249.8, filed on Aug. 16, 2006, and International Patent Application No. PCT/EP2007/007190, filed on Aug. 15, 2007, having WIPO Publication No. WO 2008/019830 and inventor Volker TILL are hereby incorporated by reference as if set forth in their entirety herein.

All of the patents, patent applications or patent publications, which were cited in the International Search Report dated Dec. 21, 2007, and/or cited elsewhere are hereby incorporated by reference as if set forth in their entirety herein as follows: EP 0209896, having the following English translation of the German title "METHOD AND APPARATUS FOR DECORATING METAL OR PLASTIC CONTAINERS," published on Jan. 28, 1987; EP 0700781, having the following English translation of the German title "REGISTER METHOD FOR CARRYING OUT PRINTING PROCESSES ON ROTATABLY SUPPORTED ARTICLES," published on Mar. 13, 1996; JP57004773, having the following English translation of the Japanese title "POSITIONING DEVICE FOR PRINTING POSITION IN PRINTING MACHINE FOR CYLINDRICAL BODY," published on Jan. 11, 1982; WO 2004/016438, having the title "CONTINUOUS FLOW INKJET UTILIZED FOR 3D CURVED SURFACE PRINTING," published on Feb. 26, 2004; and DE 44 24 528, having the following German title "VERFAHREN ZUM BEDRUCKEN VON ROTATIONSKBRPERN UND ANLAGE ZUM DURCHFOHREN DES VERFAHRENS," published on Jan. 18, 1996.

All of the patents, patent applications or patent publications, which were cited in the German Office Action dated Apr. 16, 2007, and/or cited elsewhere are hereby incorporated by reference as if set forth in their entirety herein as follows: GB 2,376,920, having the following title "INKJET PRINTING ON A THREE-DIMENSIONAL OBJECT INCLUDING RELATIVE MOVEMENT OF A PRINTHEAD AND THE OBJECT OR PRINTING ABOUT A ROTATIONAL AXIS," published on Dec. 31, 2002; WO 2004/009360, having the title "PRINTING PROCESS AND APPARATUS," published on Jan. 29, 2004; and DE 20 2006 000 270, having the following English translation of the German title "DEVICE FOR PRINTING INFORMATION ON THE BOTTLES COMPRISES AN ELECTROSTATIC PRINTHEAD HAVING INDIVIDUAL NOZZLES FOR CONTROLLED RELEASE OF PRINTING INK," published on Apr. 6, 2006.

The patents, patent applications, and patent publication listed above, beginning on line 1108 on page 53 in the paragraph with the phrase: "Some examples of bottling systems . . . " and ending on line 1250 on page 60 in the paragraph with the phrase: " . . . published on Apr. 6, 2006," are herein incorporated by reference as if set forth in their entirety. The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2006 038 247.1, filed on Aug. 16, 2006, having inventor Volker TILL, and DE-OS 10 2006 038 247.1 and DE-PS 10 2006 038 247.1, and International Application No. PCT/EP2007/007189, filed on Aug. 15, 2007, having WIPO Publication No. WO2008/019829 and inventor Volker TILL, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The corresponding foreign and international patent publication applications, namely, Federal Republic of Germany Patent Application No. 10 2006 038 249.8, filed on Aug. 16, 2006, having inventor Volker TILL, and DE-OS 10 2006 038 249.8 and DE-PS 10 2006 038 249.8, and International Application No. PCT/EP2007/007190, filed on Aug. 15, 2007, having WIPO Publication No. WO2008/019830 and inventor Volker TILL, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the Foreign equivalent patent application PCT/EP2007/007189, PCT/EP2007/07190, German Patent Application 10 2006 038 249.8, and German Patent Application 10 2006 038 247.1 is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/007189, PCT/EP2007/007190, DE 10 2006 038 249.8, and DE 10 2006 038 247.1 from which this patent application claims priority which do not have to do with the correction of the translation in this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A method of circumferentially printing onto containers, such as bottles, said method comprising the steps of:

storing artwork with associated angle markings in a control unit, which stored angle markings correspond to angular positions about the circumference of each container; and performing, for each container, a relative rotational movement of said container and at least one print head and applying said stored artwork on said container according to said stored angle markings and said angular positions, and thus producing printed artwork having a circumferential size and/or height according to the circumferential size and/or height of said container, and thus compensating for container tolerances between containers.

2. The method according to claim 1, wherein said stored artwork is supplemented exclusively by said stored angle markings regarding its expansion or contraction in the circumferential direction, so that said stored artwork is applied to the container on the basis of said angular positions in the circumferential direction.

3. The method according to claim 2, wherein said method comprises one of:

fixing said at least one print head at a specified distance from the container; and adjusting the distance between said at least one print head and the container.

4. The method according to claim 3, wherein said stored artwork is applied to the container without overlap.

5. The method according to claim 4, wherein said step of applying said stored artwork comprises adjusting distances between individual dots of color in the circumferential direction and/or in the vertical direction as a function of the size and shape of the container.

6. The method according to claim 5, wherein said step of adjusting distances between individual dots of color comprises one of: varying the distance between the dots of color or fixing the distance between the dots of color, in the circumferential direction and/or in the vertical direction.

7. The method according to claim 6, wherein said stored artwork is applied to the container in a vertical direction substantially perpendicular to the circumferential direction and is expanded or contracted in height according to the height of the container.

8. The method according to claim 7, wherein said printing comprises circumferentially printing for 360 degrees.

9. The method according to claim 8, wherein said step of producing printed artwork comprises producing printed artwork according to solely the circumferential size of said container, and thus compensating for container tolerances between containers with respect to solely circumferential size.

10. The method according to claim 1, wherein said method comprises one of:

fixing said at least one print head at a specified distance from the container; and adjusting the distance between said at least one print head and the container.

11. The method according to claim 10, wherein said stored artwork is applied to the container without overlap.

12. The method according to claim 11, wherein said step of producing printed artwork comprises producing printed artwork according to solely the circumferential size of said container, and thus compensating for container tolerances between containers with respect to solely circumferential size.

13. The method according to claim 1, wherein:

said steps of performing a relative rotational movement, applying said stored artwork, and thus producing printed artwork are performed for a first container and a subsequent, second container, which second container differs from said first container in circumferential size and/or height due to container tolerances; and said step of producing printed artwork on said second container comprises producing printed artwork having a circumferential size and/or height which is expanded or contracted in a circumferential direction and/or a vertical direction with respect to said printed artwork on said first container, and thus compensating for container tolerances between containers.

14. The method according to claim 13, wherein said step of producing printed artwork comprises producing printed artwork according to solely the circumferential size of said container, and thus compensating for container tolerances between containers with respect to solely circumferential size.

15. A printing arrangement for performing the method according to claim 1 of circumferentially printing onto containers, such as bottles, said arrangement comprising:

a control unit being configured to store artwork with associated angle markings, which stored angle markings correspond to angular positions about the circumference of a container;

a container support and at least one print head, wherein at least one of: said container support and said at least one print head is movable;

said control unit being configured to:

control said container support and said at least one print head to perform, for each of a plurality of containers, a relative rotational movement of a container and said at least one print head; and activate said at least one print head to apply said stored artwork on a container according to said stored angle markings and angular positions to produce printed artwork having a circumferential size and/or height according to the circumferential size and/or height of a container to compensate for container tolerances between containers.

16. The printing arrangement according to claim 15, wherein said printing arrangement comprises an adjustable holder configured to hold said at least one print head a predetermined distance from a container.

17. The printing arrangement according to claim 16, wherein said printing arrangement comprises a sensor configured to measure the distance of said at least one print head from a container.

18. The printing arrangement according to claim 17, wherein said control unit is configured to analyze the measurements of said sensor and utilize the measurements to adjust the position of said holder and said at least one print head to promote a constant and controlled distance between said at least one print head and a container to optimize quality of the printed image.

19. The printing arrangement according to claim 18, wherein said printing arrangement further comprises a rotational arrangement being configured to perform a relative rotational movement between a container and said at least one print head during application of said stored artwork.

20. The printing arrangement according to claim 15, wherein said control unit is configured to activate said at least one print head to apply said stored artwork on a container according to said stored angle markings and angular positions to produce printed artwork according to solely the circumferential size of a container to compensate for container tolerances between containers with respect to solely circumferential size.

* * * * *